US011317653B2

(12) United States Patent
Qiu

(10) Patent No.: US 11,317,653 B2
(45) Date of Patent: May 3, 2022

(54) VENTILATION ASSEMBLY, ATOMIZER AND ELECTRONIC CIGARETTE THEREOF

(71) Applicant: JOYETECH EUROPE HOLDING GMBH, Zug (CH)

(72) Inventor: Weihua Qiu, Jiangsu (CN)

(73) Assignee: Joyetech Europe Holding GmbH, Zug (CH)

( * ) Notice: Subject to any disclaimer, the term of this patent is extended or adjusted under 35 U.S.C. 154(b) by 734 days.

(21) Appl. No.: 16/220,570

(22) Filed: Dec. 14, 2018

(65) Prior Publication Data

US 2019/0116872 A1 Apr. 25, 2019

Related U.S. Application Data

(63) Continuation of application No. PCT/CN2017/088395, filed on Jun. 15, 2017.

(30) Foreign Application Priority Data

Jun. 17, 2016 (CN) ..... 201610438170.7

(51) Int. Cl.

| | |
|---|---|
| ***A24F 40/485*** | (2020.01) |
| ***A24F 15/015*** | (2020.01) |
| ***A24F 40/10*** | (2020.01) |
| ***A24D 3/18*** | (2006.01) |

(52) U.S. Cl.

CPC ..... *A24F 40/485* (2020.01); *A24D 3/18* (2013.01); *A24F 15/015* (2020.01); *A24F 40/10* (2020.01)

(58) Field of Classification Search

CPC ..... A24D 3/043; A24D 3/046; A24D 3/18; A24F 40/00; A24F 40/485; A24F 40/10; A24F 15/015

See application file for complete search history.

(56) References Cited

U.S. PATENT DOCUMENTS

| | | | |
|---|---|---|---|
| 2015/0272221 | A1 | 10/2015 | Liu |
| 2016/0007654 | A1 | 1/2016 | Zhu |

FOREIGN PATENT DOCUMENTS

| | | | |
|---|---|---|---|
| CN | 202949973 | U | 5/2013 |
| CN | 103462224 | A | 12/2013 |
| CN | 203435688 | U | 2/2014 |
| CN | 104509986 | A | 4/2015 |

(Continued)

*Primary Examiner* — Michael J Felton

(74) *Attorney, Agent, or Firm* — Novick, Kim & Lee, PLLC; Allen Xue

(57) ABSTRACT

The ventilation assembly for an atomizer in an electronic cigarette has a storage chamber, which includes an inlet passages and a liquid injection channel located therein. The inlet passages and the liquid injection channel are isolated from each other. The ventilation assembly further includes an injection hole, an air inlet, the injection hole is in communication with the liquid injection channel and the storage chamber sequentially; and an exhaust port, the exhaust port, and the air inlet are in communication with the inlet passages; when need to inject cigarette liquid, open the injection hole and inject the cigarette liquid into the storage chamber through the injection hole; after the liquid injection is completed, during closing the injection hole, air received in the storage chamber is discharged from the injection hole, exhaust port, the air inlet passage and the air inlet successively.

18 Claims, 15 Drawing Sheets

(56) References Cited

FOREIGN PATENT DOCUMENTS

| | | | | | |
|---|---|---|---|---|---|
| CN | 104544575 | A | * | 4/2015 | ..... A24F 40/485 |
| CN | 204519370 | U | | 8/2015 | |
| CN | 204540817 | U | | 8/2015 | |
| CN | 104939326 | A | | 9/2015 | |
| CN | 105192892 | A | | 12/2015 | |
| CN | 204861181 | U | | 12/2015 | |
| CN | 105212270 | A | | 1/2016 | |
| CN | 105286091 | A | | 2/2016 | |
| CN | 105433447 | A | | 3/2016 | |
| CN | 205082677 | U | | 3/2016 | |
| CN | 205757201 | U | | 12/2016 | |
| EP | 1736065 | A1 | | 12/2006 | |
| KR | 10-1489911 | B1 | | 2/2015 | |

* cited by examiner

VENTILATION ASSEMBLY, ATOMIZER AND ELECTRONIC CIGARETTE THEREOF

CROSS-REFERENCE TO RELATED APPLICATIONS

This application is a continuation of International Patent Application No. PCT/CN2017/088395, filed on Jun. 15, 2017, entitled "atomizer and electronic cigarette thereof", which claims priority to Chinese Patent Application No. CN201610438170.7, filed on Jun. 17, 2016, entitled "ventilation assembly, atomizer and electronic cigarette thereof". All of the aforementioned patent applications are hereby incorporated by reference in their entireties.

FIELD

The present disclosure relates to an electronic cigarette technical field, and particularly relates to a ventilation assembly, an atomizer and an electronic cigarette using the same.

BACKGROUND

Electronic cigarettes, also known as virtual cigarettes, electronic atomizers, and electronic cigars, are mainly used to simulate the feeling of smoking without affecting health, for the purpose of smoking cessation or cigarette replacement. The electronic cigarette generally includes an atomizer and a power supply device, the atomizing head of the atomizer can atomize the cigarette liquid to generate smoke for the user to smoke.

When injecting cigarette liquid into the atomizers, the atomizers in the market have the following disadvantages. Firstly, the atomizing head needs to be dissembled together with air intake component of the atomizer, and then injecting cigarette liquid into the atomizers, thus the liquid injection process is inconvenient. Secondly, the atomizing head is usually immersed in the cigarette liquid, the atomizing head dissembled from the electronic cigarette will take along cigarette liquid, which makes it inconvenient to place the atomizing head. Thirdly, frequent removal of the atomizing head, which tends to cause poor contact between the atomizing head and other components. Fourthly, after the liquid injection is completed, the atomizing head and the air intake component are installed in the atomizer, the excess air is pressed into the liquid storage device to form a high closed air pressure in the liquid storage device. Under the high closed air pressure, the cigarette liquid received in the liquid storage device is forced to migrate to the atomizing head, which will cause too much cigarette liquid in the atomizing head. In use, excessive cigarette liquid makes the atomizing head prone to oil boiling, the cigarette liquid may also be directly inhaled by the user, which will be affecting the user's use.

SUMMARY

The object of the present disclosure is to provide a ventilation assembly, an atomizer and an electronic cigarette thereof, which is convenient to add liquid, and avoids excess air entering the atomizer during the adding process, thereby ensuring a comfortable use effect.

A ventilation assembly for an atomizer having a storage chamber, includes an inlet passages and a liquid injection channel located therein, the inlet passages and the liquid injection channel are isolated from each other; the ventilation assembly further includes an injection hole, an air inlet, the injection hole is in communication with the liquid injection channel and the storage chamber sequentially; and an exhaust port, the exhaust port, and the air inlet are in communication with the inlet passages; when need to inject cigarette liquid, open the injection hole and inject the cigarette liquid into the storage chamber through the injection hole; after the liquid injection is completed, during closing the injection hole, air received in the storage chamber is discharged from the injection hole, exhaust port, the air inlet passage and the air inlet successively.

In one embodiment, the ventilation assembly further includes base seat and intake pipe, the intake pipe includes an upper panel, the opposite ends of the upper panel are respectively fixedly connected to the inner peripheral wall of the base seat, a gap between the upper panel and the peripheral wall of the base seat forms the injection hole, the exhaust port is defined in the upper panel.

In one embodiment, the ventilation assembly further includes an outer sleeve, the intake pipe further includes a lower panel located below the upper panel and parallel to the upper panel, two side plates connected between the upper panel and the lower panel, a connecting pipe located above the lower panel, the opposite ends of the lower panel are respectively connected to the inner portion of the base seat, one end of the outer sleeve is sleeved on the connecting pipe; the cavity formed between the inner peripheral wall of the base seat, the side plates, the connecting pipe, and the outer sleeve forms the liquid injection passage.

In one embodiment, the ventilation assembly further includes an inner sleeve, one end of the inner sleeve is connected to the upper panel and extends through the upper panel, the opposite end of the inner sleeve passes through the connecting pipe in the in the axial direction of the ventilation assembly to extend into the outer sleeve, a cavity formed between the upper panel, the lower panel, and the two side plates is in communication with the cavity formed between the inner sleeve and the outer sleeve to form the intake passage, the air inlet is defined in the peripheral wall of the base seat.

In one embodiment, the base seat, the outer sleeve, and the inner sleeve are coaxially disposed.

In one embodiment, wherein an adjustment ring, the adjustment ring is rotatably sleeved on the sidewall of the base seat, the adjustment ring is provided with an air adjusting hole corresponding to the air inlet, rotating the adjusting ring to adjust a communication area between the air adjusting hole and the air inlet.

In one embodiment, the air inlet of the intake passage is located at the radially outer peripheral wall of the ventilation assembly.

In one embodiment, the injection hole is located at the upper end surface of the ventilation assembly.

In one embodiment, the exhaust port is defined in the upper end surface of the intake passage.

An atomizer, includes an injection cover, a liquid storage assembly having a storage chamber; and any one of the above ventilation assembly.

In one embodiment, the upper end of the ventilation assembly is detachably connected to the injection cover, the lower end of the ventilation assembly is sleeved on the liquid storage assembly and is partially received in the liquid storage assembly, the liquid injection passage is axially disposed in the ventilation assembly, the injection hole is located at the upper end surface of the ventilation assembly, when the injection cover is mounted on the ventilation assembly, the exhaust port is sealed by the injection cover.

In one embodiment, the lower end of the liquid injection cover provides a sealing member to seal the exhaust port.

In one embodiment, the atomizer further includes an atomizing head, the atomizing head is disposed at the lower end of the ventilation assembly and is received in the liquid storage assembly, the atomizing head is detachedly connected to the ventilation assembly, the intake passage is in communication with the atomizing head.

In one embodiment, the atomizing head includes an atomizing head sleeve, an atomizing head base, a liquid injection channel, a first electrode contact, and a first insulating sleeve, the atomizing head base is fixed at the bottom of the atomizing head sleeve, the heating element is sleeved in the atomizing head sleeve, the first electrode contact extends through the first insulating sleeve and attached to the atomizing head base, the liquid injection channel is electrically connected to the first electrode contact.

In one embodiment, a base inlet hole is radially defined on the peripheral wall of the atomizing head base along the atomizing head sleeve.

In one embodiment, the liquid injection channel includes a base body, a heating plate disposed in the base body, and an electrode lead drawn from the heating plate and located outside of the base body, the electrode lead is electrical connected to the first electrode contact.

An electronic cigarette includes any one of the above ventilation assembly.

An electronic cigarette includes any one of the above atomizer.

The beneficial effects of the device are:

1. In the present disclosure, the ventilation assembly is provided with an inlet passages and liquid injection channel, which are isolated from each other. The injection hole located at the upper end surface of the ventilation assembly. When injecting cigarette liquid, only needs to dissemble the injection cover and expose the injection hole. Thus, the user can inject the cigarette liquid to the storage chamber through the injection hole. The above liquid injection operation is convenient, it is not necessary to take down the atomizing head during the liquid injection process, thus can avoid the external contamination of the atomizing head due to disassembling the atomizing head. In particular, for the atomizing head screwed to the liquid storage assembly, the poor connection, due to repeated disassembly and assembly, between the atomizing head and the liquid storage assembly can be avoided, thus the stability of the atomizer is ensured.

2. An exhaust port is also defined on the upper end surface of the ventilation assembly. After the liquid injection is completed, the injection cover is then installed on the ventilation assembly, excess air received in the storage chamber can be discharged from the exhaust port through the air inlet passage and the air inlet successively. Thereby ensuring the stability of the internal pressure of the storage chamber, can further avoid excessive oil boiling in the atomizing head during the atomizing process, and can also avoid the user inhales the un-atomized cigarette liquid, thereby improving the user experience and the suction taste.

Figure 1:
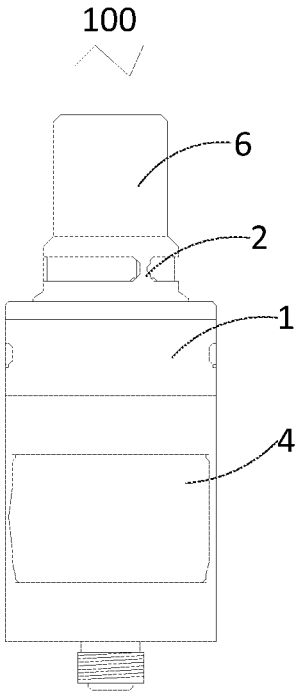
FIG. 1 is a front view of an atomizer of the present disclosure.

The following table list various components and reference numerals thereof.

| | |
|---|---|
| Atomizer 100 | Ventilation assembly 1 |
| Injection cover 2 | Atomizing head 3 |
| Liquid storage assembly 4 | Storage chamber 5 |
| Mouthpiece 6 | Intake passage 200 |
| Liquid injection channel 300 | Base seat 11 |
| Receiving portion 111 | Intake pipe 12 |
| Air inlet 121 | Exhaust port 122 |
| First end 12a | Second end 12b |
| Connection end 12c | Upper panel 123 |
| Lower panel 124 | Side plate 125 |
| Connecting pipe 126 | Outer sleeve 13 |
| Inner sleeve 14 | Injection hole 15 |
| Adjustment ring 16 | adjusting hole 161 |
| Smoke passage 21 | Sealing member 22 |
| Atomizing head sleeve 31 | Atomizing head base 32 |
| Base inlet hole 321 | Heating element 33 |
| Base body 331 | Heating plate 332 |
| Electrode lead 333 | First electrode contact 34 |
| First insulating sleeve 35 | Pedestal 41 |
| Support sleeve 42 | Glass outer tube 43 |
| Fixing device 44 | Second electrode contact 50 |
| Second insulating sleeve 51 | |

DETAILED DESCRIPTION OF PREFERRED EMBODIMENTS

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising," when utilized, means "including, but not necessarily limited to"; it specifically indicates open-ended inclusion or membership in the so-described combination, group, series and the like.

When a feature or element is herein referred to as being "on" another feature or element, it can be directly on the other feature or element or intervening features and/or elements may also be present.

Terminology used herein is for the purpose of describing particular embodiments only and is not intended to be limiting of the disclosure. As used herein, the term "and/or" includes any and all combinations of one or more of the associated listed items and may be abbreviated as "/".

Figure 2:
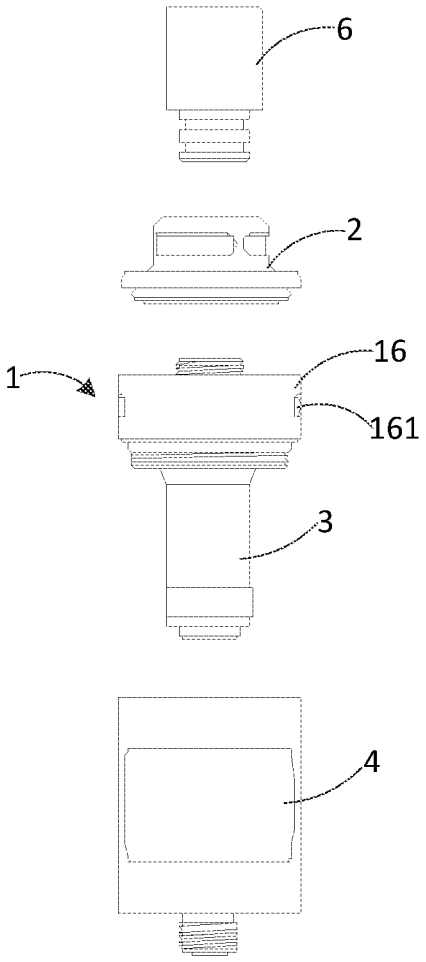
FIG. 2 is an exploded view of the atomizer of FIG. 1.
Figure 10:
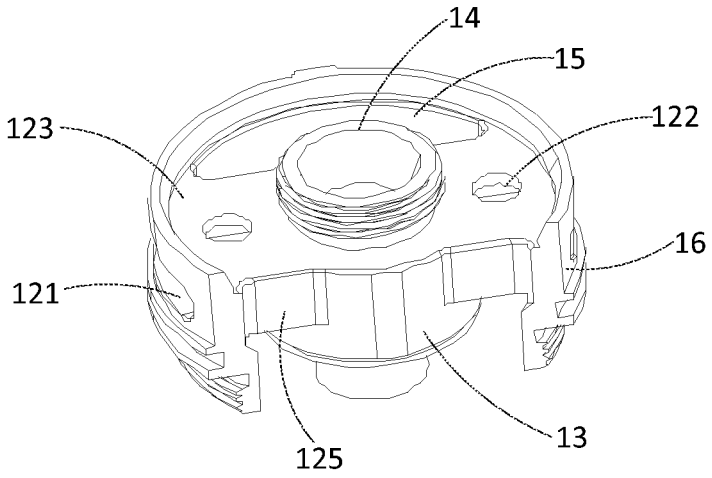
FIG. 10 is a schematic view of the ventilation assembly of FIG. 2 (without the adjusting ring) cutting off one end wall.

As shown in FIGS. 1-2 and 10, the present disclosure provides an atomizer 100, the atomizer 100 includes a ventilation assembly 1, an injection cover 2, an atomizing head 3 and a liquid storage assembly 4. The upper end of the ventilation assembly 1 is detachably connected to the injection cover 2, the lower end of the ventilation assembly 1 is sleeved on the liquid storage assembly 4 and is partially received in the liquid storage assembly 4. The atomizing head 3 is disposed at the lower end of the ventilation assembly 1. The atomizing head 3 is received in the liquid storage assembly 4 and abuts against the inner surface of the lower end of the liquid storage assembly 4. The inner space of the liquid storage assembly 4 forms a storage chamber 5 for storing cigarette liquid. Therefore, the atomizing head 3 is equivalent to immersing in the storage chamber 5. The atomizing head 3 absorbs the cigarette liquid in the storage chamber 5 and atomizes the cigarette liquid to generate smoke for the user to suck through the mouthpiece 6. On the one hand, the liquid storage assembly 4 provides a storage chamber 5 for storing the cigarette liquid, on the other hand, the liquid storage assembly 4 constitutes part of the outer contour of the atomizer 100.

In this embodiment, the ventilation assembly 1 and the injection cover 2 are detachably screwed together. It can be understood that, the ventilation assembly 1 and the liquid injection cover 2 can also be detachably connected together by plugging.

Figure 7:
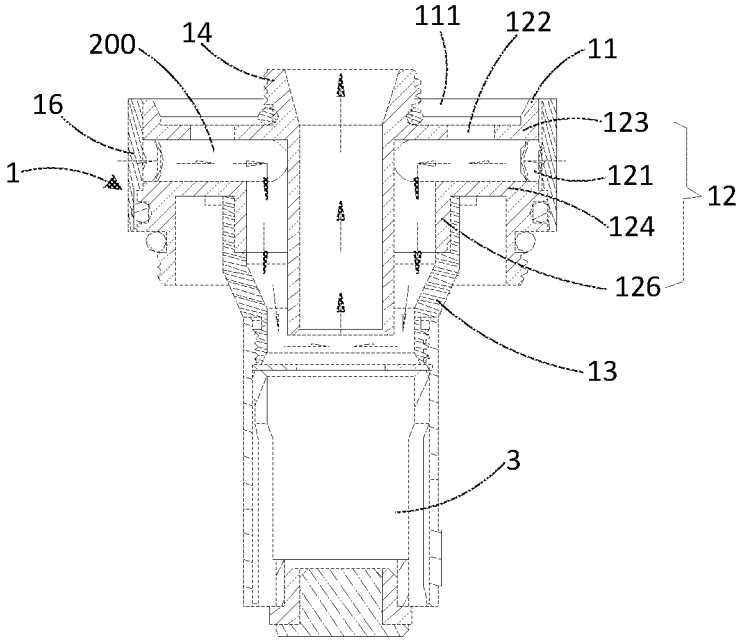
FIG. 7 is a cross-sectional view of the ventilation assembly and the atomizing head of FIG. 6 taken along line C-C.
Figure 8:
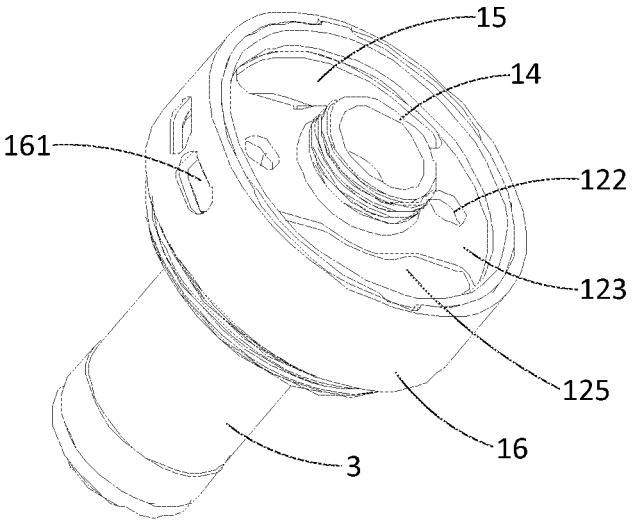
FIG. 8 is a perspective view of the ventilation assembly and the atomizing head of FIG. 2.
Figure 9:
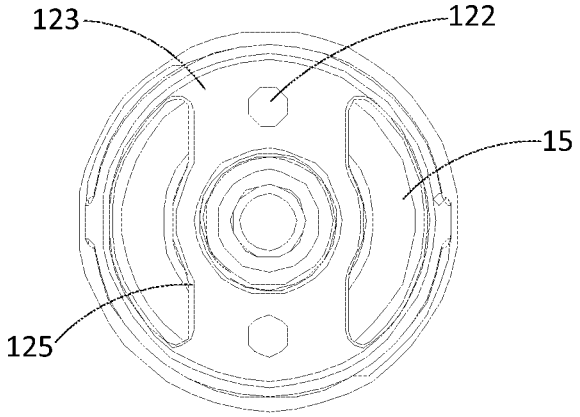
FIG. 9 is a top view of the ventilation assembly and the atomizing head of FIG. 2.

Referring to FIGS. 4-10, the ventilation assembly 1 has a substantially tubular structure. The ventilation assembly 1 is provided with an intake passage 200 and a liquid injection channel 300, which are isolated from each other. The air inlet 121 of the intake passage 200 is located at the radially outer peripheral wall of the ventilation assembly 1, the intake passage 200 is in communication with the atomizing head 3. During operation, outside air enters from the air inlet 121, to the intake passage 200, and flows out of the inner sleeve 14 with the smoke atomized by the atomizing head 3, and then is inhaled by the user, as shown in FIG. 7, the direction of the arrow in FIG. 7 is the gas flow direction.

Figure 5:
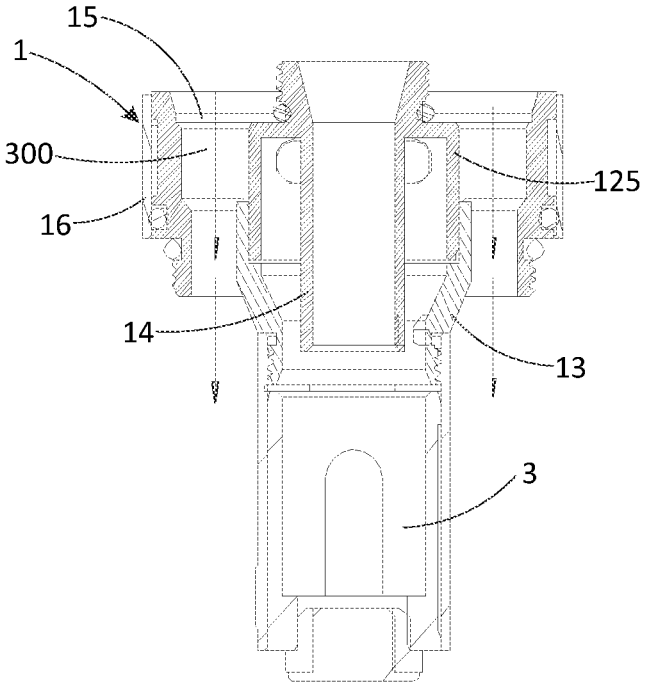
FIG. 5 is a cross-sectional view of the ventilation assembly and the atomizing head of FIG. 4 taken along line A-A.
Figure 6:
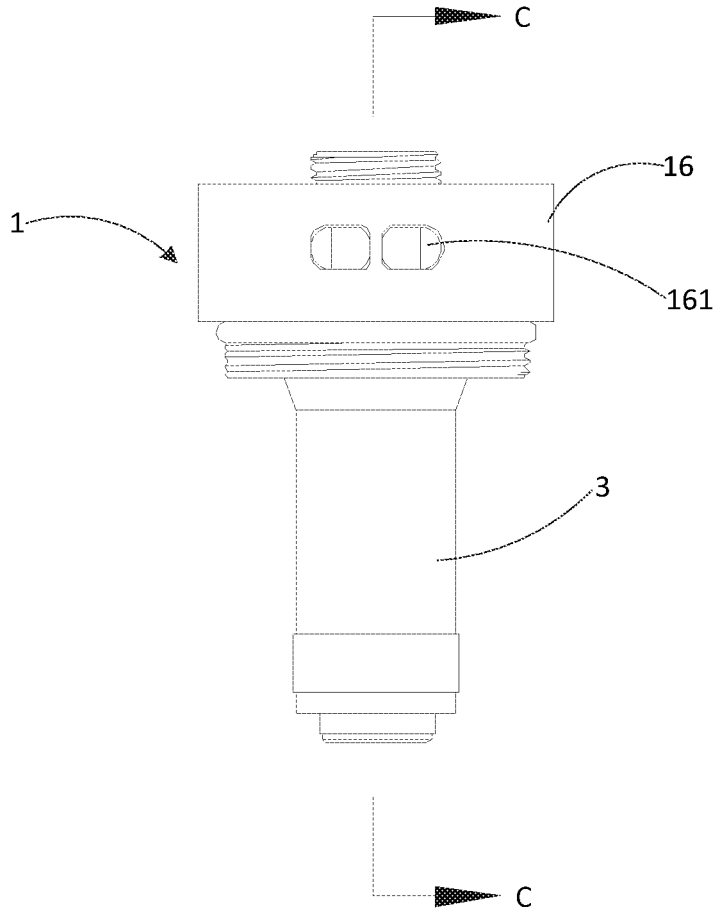
FIG. 6 is a left side view of the ventilation assembly and the atomizing head of FIG. 2.

The liquid injection channel 300 is axially disposed in the ventilation assembly 1, the liquid injection channel 300 defines an injection hole 15 in communication with the storage chamber 5. Specifically, the liquid injection channel 300 is axially disposed in the ventilation assembly 1 from the upper end surface of the ventilation assembly 1 adjacent to the injection cover 2. The injection hole 15 located at the upper end surface of the ventilation assembly 1 adjacent to the injection cover 2. As the liquid injection channel 300 is in communication with the storage chamber 5, the cigarette liquid from the injection hole 15 can enter the storage chamber 5 through the liquid injection channel 300. When the injection cover 2 is mounted on the ventilation assembly 1, the injection hole 15 is sealing shielded by the injection cover 2 and is invisible, so that the cigarette liquid injection operation cannot be performed. When injecting cigarette liquid, only needs to dissemble the injection cover 2 and expose the injection hole 15. Thus, the user can inject the cigarette liquid to the storage chamber 5 through the injection hole 15, as shown in FIG. 5. The arrow in the FIG. 5 indicates the direction of liquid injection. The above liquid injection operation is convenient, it is not necessary to take down the atomizing head 3 during the liquid injection process, thus can avoid the external contamination of the atomizing head 3 due to disassembling the atomizing head 3. In particular, for the atomizing head 3 screwed to the liquid storage assembly 4, the poor connection, due to repeated disassembly and assembly, between the atomizing head 3 and the liquid storage assembly 4 can be avoided, thus the stability of the atomizer 100 is ensured.

An exhaust port 122 in communication with the intake passage 200 is also defined on the upper end surface of the ventilation assembly 1. When the injection cover 2 is attached to the ventilation assembly 1, the exhaust port 122 is sealing covered by the injection cover 2. After the liquid injection is completed, the injection cover 2 is then installed on the ventilation assembly 1, excess air received in the storage chamber 5 can be discharged from the exhaust port 122 through the air intake passage 200 and the air inlet 121 successively, thereby ensuring the stability of the internal pressure of the storage chamber 5, can further avoid excessive oil boiling in the atomizing head 3 during the atomizing process, and can also avoid the user inhaling the unatomized cigarette liquid, thereby improving the user experience and the suction taste.

In the embodiment, the ventilation assembly 1 includes a base seat 11 having a hollow cavity, an intake pipe 12, an outer sleeve 13 and an inner sleeve 14. The base seat 11 is a substantially hollow tubular body, the inner sleeve 14 is disposed in the hollow cavity of the base seat 11. The outer sleeve 13 is disposed between the inner sleeve 14 and the base seat 11. The base seat 11, the outer sleeve 13, and the inner sleeve 14 are coaxially disposed.

Figure 11:
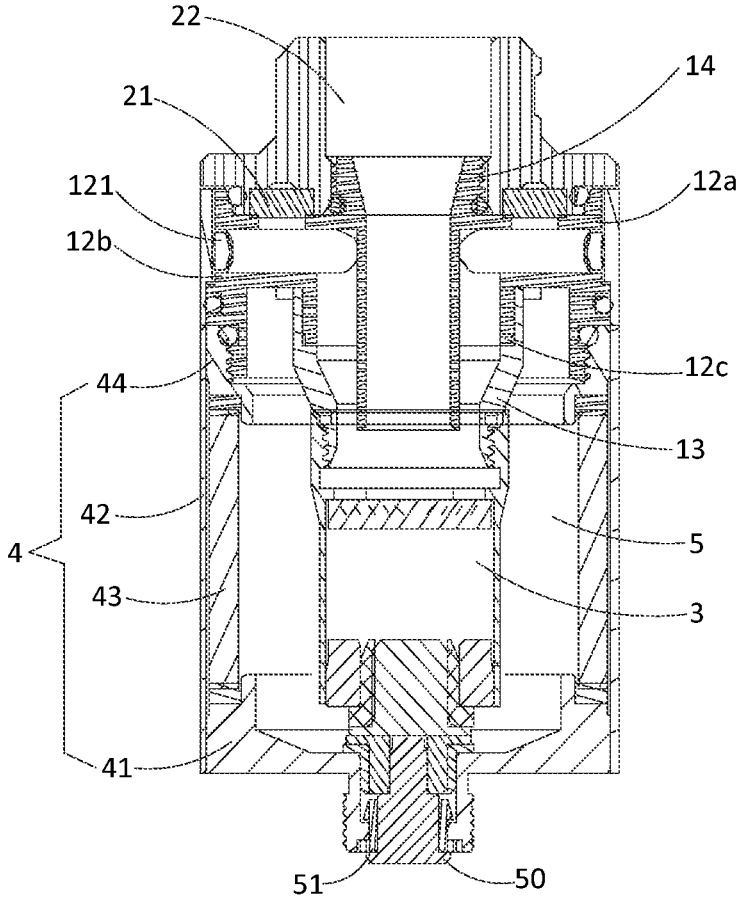
FIG. 11 is a cross-sectional view of the atomizer of FIG. 1 (without a mouthpiece)
Figure 12:
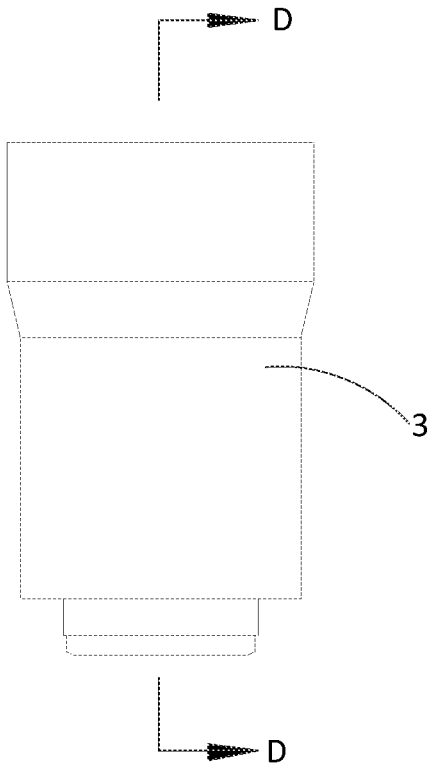
FIG. 12 is a front view of the atomizing head of FIG. 2.
Figure 13:
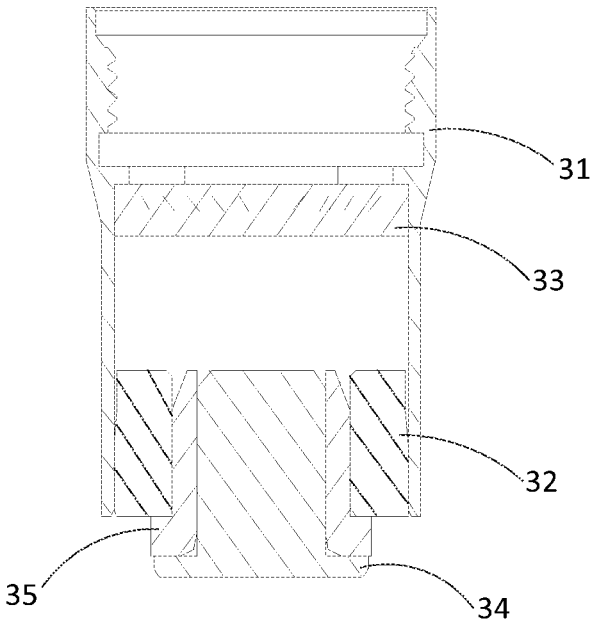
FIG. 13 is a cross-sectional view of the atomizing head of FIG. 12 taken along line D-D.
Figure 14:
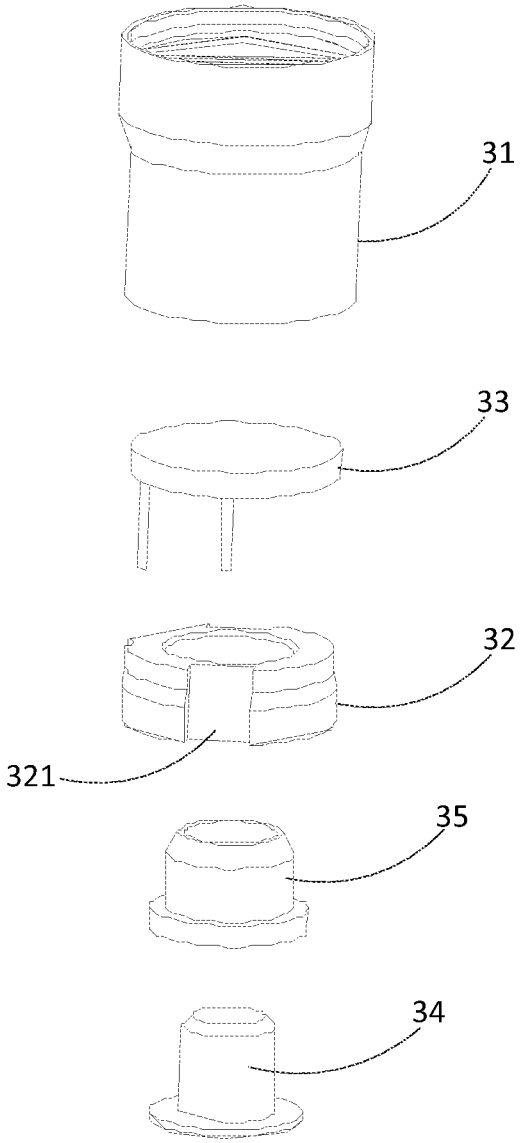
FIG. 14 is an exploded view of the atomizing head shown in FIG. 12.
Figure 15:
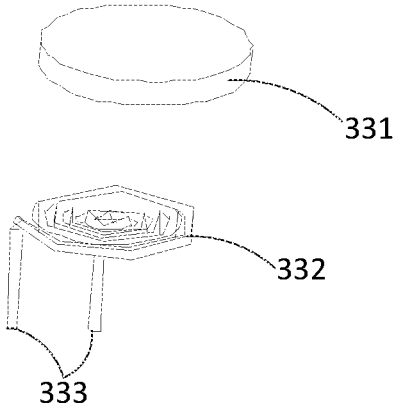
FIG. 15 is an exploded view of the liquid injection channel shown in FIG. 14.

Referring again to FIG. 11, the intake pipe 12 is substantially T-shaped, the intake pipe 12 includes a first end 12*a*, a second end 12*b* opposite to the first end 12*a*, and a connection end 12*c* perpendicular to the first end 12*a* and the second end 12*b*. The first end 12*a*, the second end 12*b* and the connection end 12*c* are in communication with each other. The first end 12*a* and the second end 12*b* are radially disposed in the base seat 11 and are fixed on the peripheral wall of the base seat 11, respectively. At least one end (the first end 12*a* or the second end 12*b*) of the intake pipe 12 passes through the peripheral wall of the base seat 11 to form the air inlet 121. The inner sleeve 14 extends through the intake pipe 12 axially along the base seat 11, the inner sleeve 14 and the intake pipe 12 are not in communication with each other and are respectively sealed. In this embodiment, the inner sleeve 14 and the connection end 12*c* are disposed coaxially. The exhaust port 122 is defined in the peripheral wall of the intake pipe 12 towards to the injection cover 2. In this embodiment, the number of the exhaust ports 122 is two, which are respectively disposed adjacent to the first end 12*a* and the second end 12*b*.

One end of the outer sleeve 13 is sleeved on the outer circumference of the connection end 12*c* of the intake pipe 12 and is in communication with the intake pipe 12. The opposite end of the outer sleeve 13 is screwed to the atomizing head 3. It can be understood that, other types of detachable connections, such as clamping connection, magnetic connection, etc., are also within the scope of the present discourse. The lower portion of the inner sleeve 14 is sleeved in the outer sleeve 13, a cavity formed between the inner sleeve 14 and the outer sleeve 13 is in communication with the intake pipe 12 to form an intake passage 200. A cavity formed between the inner peripheral wall of the base seat 11, the outer sleeve 13 and the intake pipe 12 constitutes a liquid injection channel 300, the intake passage 200 and the liquid injection channel 300 are two independent passages, which are not in communication with each other.

Specifically, in the embodiment, the intake pipe 12 is formed by an upper panel 123, a lower panel 124, two side plates 125 connected between the upper panel 123 and the lower panel 124, an air inlet 121 defined in the peripheral wall of the base seat 11, and a connecting pipe 126 formed by betting the lower panel 124 in the direction towards to the outer sleeve 13. The upper panel 123 and a lower panel 124 are disposed in parallel and have an opening defined in the middle thereof respectively. The upper panel 123 and the lower panel 124 are sleeved on the outer circumference of the inner sleeve 14. The opposite ends of the upper panel 123 are fixedly connected to the inner peripheral wall of the base seat 11, respectively. The opposite ends of the lower panel 124 are also connected to the inner portion of the base seat 11, respectively. The opposite side edges of each side plate 125 are respectively connected to the side edges on the same side of the upper panel 123 and the lower panel 124, the upper end of the outer sleeve 13 is sleeved on the outer circumference of the connecting pipe 126. Thus, the cavity formed between the inner sleeve 14 and the outer sleeve 13 is in communication with the intake pipe 12 to form the liquid injection channel 300. The intake pipe 12 is formed by a side plate, the upper panel 123 and the lower panel 124. The inner peripheral wall of the base seat 11, each side plates 125, the connecting pipe 126, and the outer sleeve 13 form the liquid injection channel 300. The gap between the upper panel 123 and the peripheral wall of the base seat 11 forms an injection hole 15. In the embodiment, two injection holes 15 are formed between the upper panel 123 and the peripheral wall of the base seat 11. In the embodiment, the two injection holes 15 are symmetrically arranged, each of the injection holes 15 has a half moon shape. The exhaust port 122 is defined in the upper panel 123.

It can be understood that the upper panel 123, the lower panel 124, the side plate 125, the air inlet 121, and the connecting pipe 126 are integrally formed, that is, the intake pipe 12 can also be an integrally formed T-shaped hollow tube. The hollow tube can be a round tube or a square tube.

The horizontal plane of the top of the inner sleeve 14 is higher than the horizontal plane of the top of the peripheral wall of the base seat 11. The upper end of the inner sleeve 14 located above the upper panel 123 forms an extension portion having an external thread. The lower end of the liquid injection cover 2 provides an internal thread corresponding to the external thread of the inner sleeve 14. The liquid injection cover 2 and the inner sleeve 14 are screwed together. The screwing connection is convenient for disassemble and assemble, and has good stability. It can be understood that, other types of detachable connections, such as clamping connection, magnetic connection, etc., are also within the scope of the present discourse.

It can be understood that the base seat 11, the intake pipe 12, the outer sleeve 13 and the inner sleeve 14 are integrally formed, thus reducing the assembly process, it is also ensured that the intake passage 200 and the liquid injection channel 300 have better airtightness.

Furthermore, the ventilation assembly 1 further includes an adjustment ring 16. The adjustment ring 16 is rotatably sleeved on the side wall of the base seat 11, the adjustment ring 16 is provided with an air adjusting hole 161 corresponding to the air inlet 121. Rotating the adjustment ring 16 can adjust the communication area of the adjusting hole 161 and the air inlet 121 to control the amount of air entering through the air inlet 121.

Figure 3:
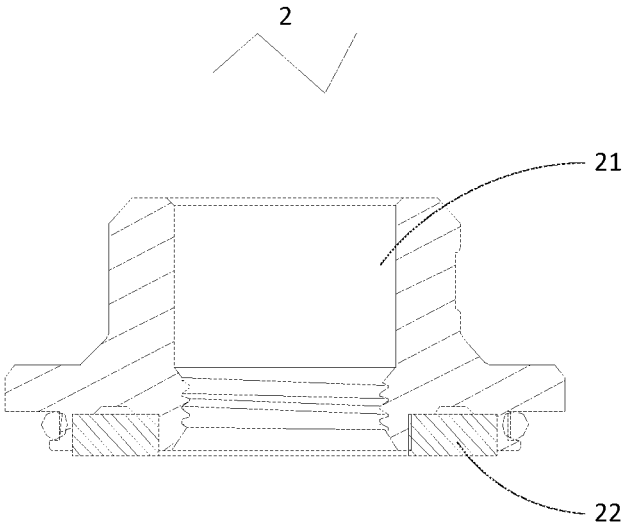
FIG. 3 is a cross-sectional view of the liquid filling cover shown in FIG. 2.
Figure 4:
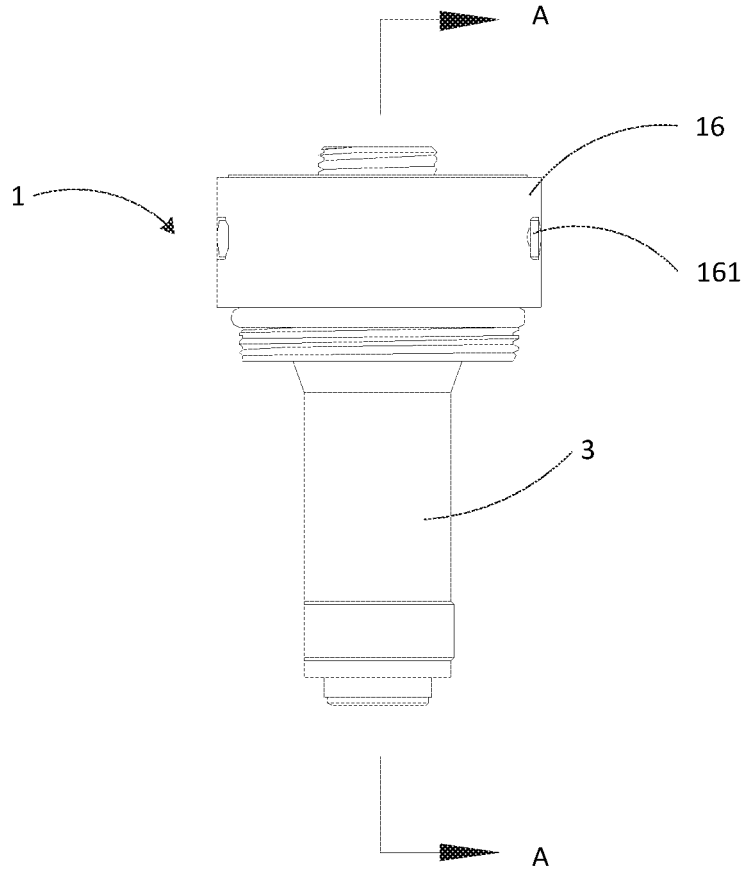
FIG. 4 is a front view of the ventilation assembly and the atomizing head of FIG. 2.

Please refer to FIG. 3, the upper end of the liquid injection cover 2 is screwed to the mouthpiece 6, the two can also use other detachable connections such as plugging or snapping, are not limited. The lower end of the liquid injection cover 2 is fixed on the ventilation assembly 1. The liquid injection cover 2 is provided with a smoke passage 21 in communication with the inner sleeve 14 and the mouthpiece 6. The lower end of the liquid injection cover 2 defines a recess corresponding to the exhaust port 122, a sealing member 22 is mounted in the recess. When the liquid injection cover 2 is mounted on the base seat 11, the exhaust port 122 is completely sealed by the sealing member 22 to prevent the cigarette liquid from leaking into the intake passage 200 through the exhaust port 122 to affect the taste of smoking. The liquid injection cover 2 and the ventilation assembly 1 are completely closed to prevent leakage of cigarette liquid from the injection hole 15. In this embodiment, the recess defined in the liquid injection cover 2 is an annular groove, the sealing member 22 is an annular body.

Furthermore, the sealing member 22 is made of silica gel. The sealing member 22 made of silica gel has very good elasticity. When the liquid injection cover 2 and the base seat 11 are mounted together, the sealing member 22 can ensure the airtightness at the exhaust port 122.

It can be understood that, the sealing member 22 can also be made of other materials, such as elastic rubber, elastic plastic, or the like.

Furthermore, a recessed receiving portion 111 is formed between the base seat 11, the upper panel 123 and the inner sleeve 14. The sealing member 22 is located in the receiving portion 111, is not easy to move, and can make the structure more stable.

Furthermore, the inner sleeve 14 is sleeved with a sealing ring, the liquid injection cover 2 and the inner sleeve 14 are interference fitted together. When the liquid injection cover 2 and the base seat 11 are mounted together, the airtightness of the exhaust port 122 is increased, the connection between the inner sleeve 14 and the mouthpiece 6 is tighter, which can avoid leakage of smoke at the junction of the liquid injection cover 2 and the inner sleeve 14.

Referring to FIGS. 11-15, in the embodiment, the atomizing head 3 includes an atomizing head sleeve 31, an atomizing head base 32, a heating element 33, a first electrode contact 34, and a first insulating sleeve 35. The atomizing head sleeve 31 is a hollow tube with two openings at opposite ends, the atomizing head base 32 is located at the bottom of the atomizing head sleeve 31, the heating element 33 is sleeved in the atomizing head sleeve 31. The first electrode contact 34 extends through the first insulating sleeve 35 and is tightly attached to the atomizing head base 32. The heating element 33 is electrically connected to the first electrode contact 34. The atomizing head base 32 defines a base inlet hole 321 in communication with the storage chamber 5. Specially, the base inlet hole 321 is radially defined on the peripheral wall of the atomizing head base 32 along the atomizing head sleeve 31. The cigarette liquid flows out of the liquid storage chamber 5, enters the atomizing head sleeve 31 through the base inlet hole 321, and is atomized into smoke under the heating of the heating element 33.

Further, the heating element 33 includes a base body 331, a heating plate 332 disposed in the base body 331, and an electrode lead 333 drawn from the heating plate 332 and located outside of the base body 331. The electrode lead 333 is electrical connected to the first electrode contact 34. The base body 331 is made of a ceramic material.

In the embodiment, the liquid storage assembly 4 includes a pedestal 41, a support sleeve 42, a glass outer tube 43, and a fixing device 44 disposed in sequence. The glass outer tube 43 is sleeved in the support sleeve 42, the pedestal 41 is located at the lower end of the support sleeve 42. Correspondingly, the fixing device 44 is located at the upper end of the support sleeve 42. Such that after the assembly is completed, the ventilation assembly 1 is mounted on the liquid storage assembly 4, the atomizing head 3 is housed in the liquid storage assembly 4. In one embodiment, the fixing device 44 is a collar with an internal thread, the base seat 11 of the ventilation assembly 1 is also provided with a corresponding thread on the corresponding position, thereby be the ventilation assembly 1 can be securely and sealingly mounted on the liquid storage assembly 4.

The storage chamber 5 is in communication with the liquid injection channel 300. The liquid smoke passes through the injection hole 15, the storage chamber 5, and the liquid injection channel 300 successively, and finally flows into the atomizing head 3 to be atomized. It can be understood that, the bottom of the pedestal 41 is further provided with a second electrode contact 50. The second electrode contact 50 is tightly mounted on the pedestal 41 through the second insulating sleeve 51, the first electrode contact 34 located in the atomizing head 3 is in electrical contact with the second electrode contact 50.

The present disclosure also provides an electronic cigarette (not shown) using the atomizer 100 described above, which is convenient to add cigarette liquid, and avoids excess gas entering the atomizer 100 during the adding process, thereby ensuring a comfortable use effect.

The above-mentioned embodiments merely represent several implementations of the present application, and the descriptions thereof are more specific and detailed, but they shall not be understood as a limitation on the scope of the present application. It should be noted that, for those of ordinary skill in the art, variations and improvements may still be made without departing from the concept of the present application, and all of which shall fall into the protection scope of the present application. Therefore, the scope of protection of the present application shall be subject to the appended claims.

What is claimed is:

1. A ventilation assembly for an atomizer having a storage chamber, comprising:

comprises an air inlet connected to an air intake passage, a base seat, an intake pipe, an outer sleeve, a connecting pipe, and an outer sleeve, wherein the intake pipe comprises an upper panel, a lower panel parallelly disposed below the upper panel, two side plates connected between the upper panel and the lower panel, and a connecting pipe disposed above the lower panel, wherein the upper panel has two opposite ends that are connected to an inner peripheral wall of the base seat and an exhaust port defined on the upper panel, and the lower panel has two opposite ends that are connected to the inner peripheral wall of the base seat, wherein one end of the outer sleeve is sleeved on the connecting pipe, and the inner peripheral wall of the base seat, the two side plates, the connecting pipe, and the outer sleeve forms a liquid injection channel, wherein the liquid injection channel has a first end connected a storage chamber and a second end connected to an injection hole formed between the upper panel and the peripheral wall of the base seat, wherein the air intake passage and the liquid injection channel are isolated from each other, wherein, the injection hole is configured to open and receive cigarette liquid to be stored in the storage chamber and when the injection hole is closed, in the storage chamber is vented through the injection hole, the exhaust port, the air intake passage and the air inlet successively.

2. The ventilation assembly according to claim 1, wherein the ventilation assembly further comprises an inner sleeve, a first end of the inner sleeve is connected to the upper panel and extends through the upper panel, a second end of the inner sleeve passes through the connecting pipe in the in an axial direction of the ventilation assembly to extend into the outer sleeve, a cavity formed between the upper panel, the lower panel, and the two side plates is in communication with the cavity formed between the inner sleeve and the outer sleeve to form the air intake passage, the air inlet is defined in the peripheral wall of the base seat.

3. The ventilation assembly according to claim 2, wherein the base seat, the outer sleeve, and the inner sleeve are coaxially disposed.

4. The ventilation assembly according to claim 1, further comprising an adjustment ring rotatably sleeves over a sidewall of the base seat, the adjustment ring is provided with an air adjusting hole corresponding to the air inlet, rotating the adjusting ring causes a change in an overlapping area between the air adjusting hole and the air inlet.

5. The ventilation assembly according to claim 1, wherein the air inlet is located at an outer peripheral wall of the ventilation assembly.

6. The ventilation assembly according to claim 1, wherein the injection hole is located at an upper end surface of the ventilation assembly.

7. The ventilation assembly according to claim 1, wherein the exhaust port is defined in an upper end surface of the air intake passage.

8. An atomizer, comprising:

an injection cover, a liquid storage assembly having a storage chamber; and the ventilation assembly of claim 1 disposed on the liquid storage assembly.

9. The atomizer according to claim 8, wherein an upper end of the ventilation assembly is detachably connected to the injection cover, a lower end of the ventilation assembly is sleeved on the liquid storage assembly and is partially received in the liquid storage assembly, the liquid injection channel is axially disposed in the ventilation assembly, the injection hole is located at the upper end surface of the ventilation assembly, when the injection cover is mounted on the ventilation assembly, the exhaust port is sealed by the injection cover.

10. The atomizer according to claim 9, wherein a lower end of the injection cover has a sealing member that seals the exhaust port.

11. The atomizer according to claim 8, wherein the atomizer further comprises an atomizing head, that is disposed at a lower end of the ventilation assembly and is received in the liquid storage assembly, the atomizing head is detachedly connected to the ventilation assembly, and the air intake passage is in communication with the atomizing head.

12. The atomizer according to claim 11, wherein the atomizing head comprises an atomizing head sleeve, an atomizing head base, a first electrode contact, and a first insulating sleeve, the atomizing head base is located at the bottom of the atomizing head sleeve, a heating element is sleeved in the atomizing head sleeve, the first electrode contact extends through the first insulating sleeve and is attached to the atomizing head base, and the liquid injection channel is electrically connected to the first electrode contact.

13. The atomizer according to claim 12, wherein a base inlet hole is radially defined on a peripheral wall of the atomizing head base along the atomizing head sleeve.

14. The atomizer according to claim 12, wherein the liquid injection channel comprises a base body, a heating plate disposed in the base body, and an electrode lead drawn from the heating plate and located outside of the base body, and the electrode lead is electrical connected to the first electrode contact.

15. An electronic cigarette, comprising:

an atomizer, comprises:

an injection cover, a liquid storage assembly having a storage chamber; and a ventilation assembly of claim 1 disposed on the liquid storage assembly.

16. The electronic cigarette according to claim 15, wherein the upper end of the ventilation assembly is detachably connected to the injection cover, a lower end of the ventilation assembly is sleeved on the liquid storage assembly and is partially received in the liquid storage assembly, the liquid injection channel is axially disposed in the ventilation assembly, the injection hole is located at the upper end surface of the ventilation assembly, when the injection cover is mounted on the ventilation assembly, the injection hole is sealed by the injection cover.

17. The electronic cigarette according to claim 16, wherein a lower end of the injection cover is provided with a sealing member for sealing the exhaust port.

18. The electronic cigarette according to claim 15, wherein the atomizer further comprises an atomizing head, that is disposed at a lower end of the ventilation assembly and is received in the liquid storage assembly, the atomizing head is detachedly connected to the ventilation assembly, and the air intake passage is in communication with the atomizing head.

* * * * *